US010518126B1

(12) United States Patent
Krull

(10) Patent No.: US 10,518,126 B1
(45) Date of Patent: Dec. 31, 2019

(54) ELLIPTICAL EXERCISE METHODS AND APPARATUS

(71) Applicant: Mark A. Krull, New Braunfels, TX (US)

(72) Inventor: Mark A. Krull, New Braunfels, TX (US)

( * ) Notice: Subject to any disclaimer, the term of this patent is extended or adjusted under 35 U.S.C. 154(b) by 195 days.

(21) Appl. No.: 15/607,569

(22) Filed: May 29, 2017

Related U.S. Application Data

(60) Provisional application No. 62/343,534, filed on May 31, 2016.

(51) Int. Cl.
*A63B 22/00* (2006.01)
*A63B 21/00* (2006.01)
*A63B 21/22* (2006.01)

(52) U.S. Cl.
CPC ..... *A63B 22/0087* (2013.01); *A63B 21/22* (2013.01); *A63B 21/4035* (2015.10); *A63B 21/4047* (2015.10); *A63B 22/0015* (2013.01); *A63B 22/0046* (2013.01)

(58) Field of Classification Search
None
See application file for complete search history.

(56) References Cited

U.S. PATENT DOCUMENTS 5,580,340 A * 12/1996 Yu ..... A63B 21/055 482/72
5,836,855 A * 11/1998 Eschenbach ..... A63B 22/001 482/57
6,017,295 A * 1/2000 Eschenbach ..... A63B 22/001 280/257
6,171,217 B1 * 1/2001 Cutler ..... A63B 22/0664 482/52
6,217,486 B1 * 4/2001 Rosenow ..... A63B 21/15 482/52
6,302,832 B1 * 10/2001 Stearns ..... A63B 21/00072 482/72
7,141,008 B2 * 11/2006 Krull ..... A63B 22/001 482/70
7,736,240 B2 * 6/2010 Chuang ..... A63B 69/04 434/247
7,824,274 B2 * 11/2010 Chuang ..... A63B 69/04 472/135
7,828,665 B2 * 11/2010 Chuang ..... A63B 69/04 434/247
7,828,666 B2 * 11/2010 Chuang ..... A63B 69/04 434/247
7,867,100 B2 * 1/2011 Chuang ..... A63B 69/04 434/247

* cited by examiner

*Primary Examiner* — Stephen R Crow

(57) ABSTRACT

A linkage assembly movably supports a seat relative to a frame for movement of the seat through an elliptical path of motion. The elliptical path may be selectively adjusted by repositioning linkage assembly components relative to one another. At least some of the elliptical paths have a length greater than a diameter defined by a crank that rotates in conjunction with the elliptical motion. Handles are also movably supported by the linkage assembly for movement through an arcuate path of motion. The handle path may be selectively adjusted in conjunction with adjustment of the seat path or independent of adjustment of the seat path.

21 Claims, 6 Drawing Sheets

ELLIPTICAL EXERCISE METHODS AND APPARATUS

CROSS-REFERENCE TO RELATED APPLICATIONS

Disclosed herein is subject matter entitled to the earlier filing date of U.S. Provisional Application No. 62/343,534, filed May 31, 2016.

FIELD OF THE INVENTION

The present invention relates to exercise methods and apparatus, and more specifically to exercise equipment having a user supporting seat that moves through an elliptical path of motion.

BACKGROUND OF THE INVENTION

Past efforts have led to various inventions directed toward exercise equipment. In one respect, the present invention may be described in terms of improvements to the exercise apparatus disclosed in U.S. Pat. No. 7,141,008 to Krull et al.

SUMMARY OF THE INVENTION

The present invention provides an exercise apparatus having a stationary frame; a crank rotatably mounted on the frame; and a user supporting seat. A linkage is interconnected between the seat, the crank, and the frame to link rotation of the crank to movement of the seat through at least one elliptical path.

One aspect of the present invention involves configuring the linkage in a manner that de-couples vertical travel of the seat and horizontal travel of the seat. On certain embodiments, vertical travel of the seat is determined/limited by an effective crank diameter defined by rotation of the crank, and horizontal travel of the seat is determined/amplified by a pivoting rocker link connected to the crank. For example, the crank is linked to a first point on the rocker link, and the seat is linked to a second point on the rocker link, which is relatively further from the rocker link pivot axis. As a result, the seat can be made to travel through an elliptical path having a relatively long horizontal major axis and a relatively short vertical minor axis. In addition, the major axis can exceed the effective crank diameter defined by rotation of the crank.

Another aspect of the present invention is to adjust the elliptical path through which the seat travels. For example, one or more pivot points associated with the amplifying rocker link may be adjusted along the rocker link to adjust range of pivoting as a function of distance from the pivot point for any given angular deflection.

Another aspect of the present invention is to connect left and right handles to the linkage in a manner that links movement of the handles to rotation of the crank. For example, on certain embodiments, left and right handlebars are pivotally mounted on the frame between the seat and the crank. Adjustments to the handle travel and the seat travel may be made contemporaneously and/or independently to achieve various ratios between "stroke length" of the handles and "stroke length" of the seat, as well as extreme positions of the handles relative to extreme positions of the seat.

Many features and/or advantages of the present invention will become apparent from the more detailed description that follows.

BRIEF DESCRIPTION OF THE FIGURES OF THE DRAWING

With reference to the Figures of the Drawing, wherein like numerals represent like components throughout the several views.

DETAILED DESCRIPTION OF A PREFERRED EMBODIMENT

Generally speaking, the subject invention may be described in terms of improvements to the apparatus disclosed in U.S. Pat. No. 7,141,008 to Krull et al., which is incorporated herein by reference. Recognizing that the subject invention shares certain attributes with the apparatus disclosed in the above-referenced patent, and that reference may be made to the patent for better understanding of those shared attributes, this description focuses primarily on distinctions and improvements.

Figure 1:
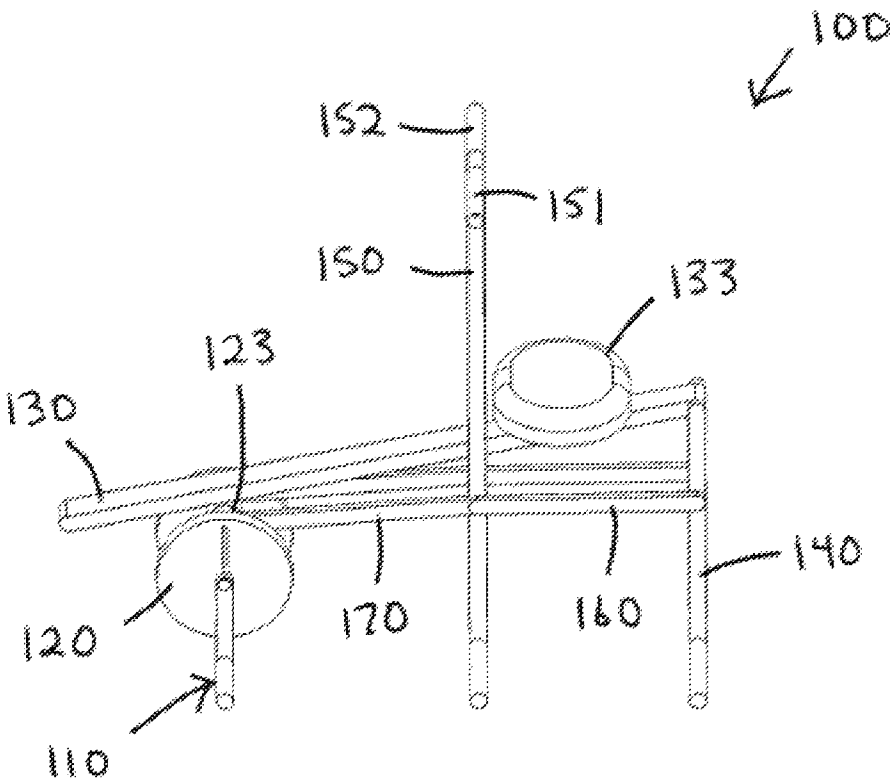
FIG. 1 is a diagrammatic perspective view of a first exercise apparatus constructed according to the principles of the present invention.
Figure 2:
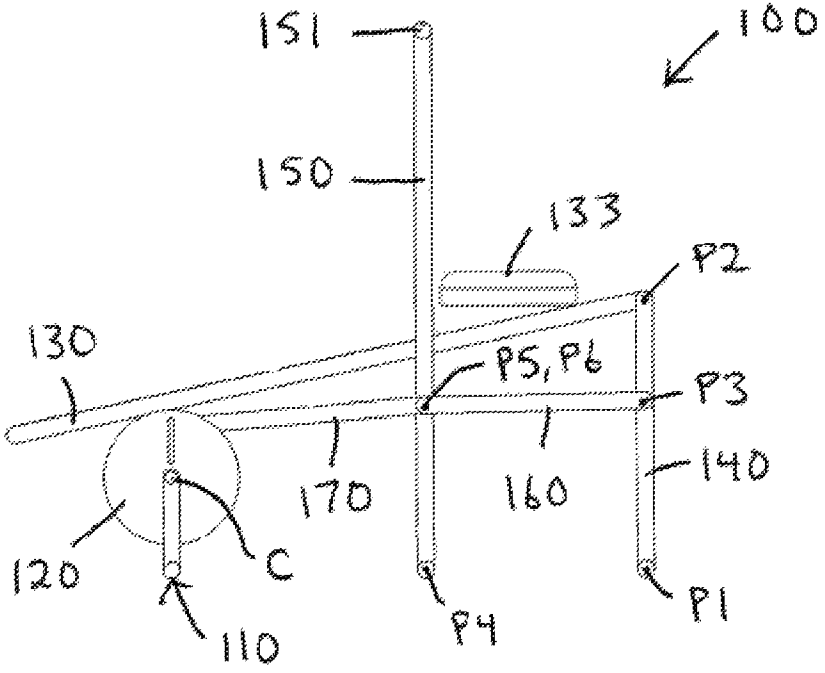
FIG. 2 is a diagrammatic side view of the exercise apparatus of FIG. 1.

FIGS. 1-2 show a first exercise apparatus 100 constructed according to the principles of the present invention. The apparatus includes a frame 110, only a portion of which is shown in FIGS. 1-2. The frame 110 includes a crank supporting stanchion (shown) and left and right base members (not shown) rigidly secured to the stanchion and extending the length of the apparatus 100 (left to right in FIGS. 1-2). Transversely extending base members are preferably rigidly interconnected between the longitudinal base members to enhance structural integrity. Unless otherwise stated, all structural components of the frame 110 are preferably rigid steel tubes, and adjacent tubes are interconnected by known means, including nuts and bolts and/or welds. The frame 110 is configured to occupy a stable position on top of an underlying floor surface and to define attachment points for various moving parts of the apparatus 100.

Left and right cranks 120 are rotatably mounted on the frame 110 in a manner known in the art to rotate together about a crank axis C (and to define a gap therebetween). Persons skilled in the art will recognize that a single crank may be used in the alternative (by mounting crank supporting rollers about the periphery of the single crank). The cranks 120 are shown as rigid steel discs, but may be configured as rigid crank arms in the alternative. The cranks 120 are preferably connected to a conventional resistance device in a manner known in the art.

A shaft is rigidly interconnected between the cranks at a radial distance from the crank axis C, and the shaft extends parallel to the crank axis C (and spans the gap between the cranks). A crank roller 123 is rotatably mounted on the shaft. As further discussed below, left and right drawbars or drawbar links 170 have first ends and opposite, second ends, and the first ends are rotatably mounted on respective ends of the radially displaced shaft (with the roller 123 disposed therebetween). Persons skilled in the art will recognize that a single drawbar may be used in the alternative and/or that the use of dual drawbars 170 may more evenly distribute loads. In any event, several variations of this "crank roller and drawbar" arrangement are disclosed in U.S. Pat. No. 5,893,820 to Maresh et al., which is incorporated herein by reference. Persons skilled in the art will also recognize that a "crank link and drawbar" arrangement may be used in lieu of the depicted arrangement to arrive at additional embodiments of the subject invention. Several variations of this "crank link and drawbar" arrangement are disclosed in U.S. Pat. No. 5,792,026 to Maresh et al., which is also incorporated herein by reference.

A foot platform (not shown) is mounted on the frame 110 and preferably disposed above the cranks 120. An example of a suitable foot platform is disclosed in the above-referenced Krull patent. At an end of the frame 110 opposite the cranks 120 (and the foot platform), a rocker link 140 has a lower end pivotally connected to the frame 110 for pivoting about a pivot axis P1. For example, in a manner known in the art, bearings are disposed in left and right longitudinal frame members to receive opposite ends of a transversely extending shaft on the lower end of the rocker link 140. An opposite, upper end of the rocker link 140 is "forked" and pivotally connected to a rearward end of a beam 130, thereby defining a pivot axis P2, which is constrained to travel in an arc about the pivot axis P1. An opposite, forward end of the beam 130 is disposed on top of the roller 123, thereby accommodating both rotation and translation of the beam 130 relative to the roller 123 (as the cranks 120 rotate).

Various provisions may be made to encourage the beam 130 to remain in a desired relationship relative to the roller 123. For example, radially projecting flanges or guides may be provided on the ends of the roller 123 to encourage the beam 130 to remain centered on the roller 123; and/or a bail may be interconnected between the forward ends of the drawbars 170 to straddle and overlie the forward end of the beam 130; and/or the frame 110 may be configured to define a slot forward of the cranks 120 to slidably receive and/or retain the forward end of the beam 130; and/or a resilient member, such as an elastic band, may be secured between the frame 110 and the forward end of the beam 130.

A conventional seat 133 is mounted on top of the beam 130 proximate the rearward end. The seat 133 is preferably of a known type for rowing exercise apparatus, and is preferably padded and upholstered. In a manner known in the art (e.g. a fastener inserted through aligned holes), the location of the seat 133 along the beam is preferably adjustable to accommodate users of different sizes (relative to the foot platform described above).

Between the cranks 120 and the rocker link 140, a rocker link or handlebar 150 has a lower end pivotally connected to the frame 110 for pivoting about a pivot axis P4. For example, in a manner known in the art, bearings are disposed in left and right longitudinal frame members to receive opposite ends of a transversely extending shaft on the lower end of the handlebar 150. An opposite, upper end of the handlebar 150 includes left and right hand grips or handles 151 and 152 that are sized and configured to be grasped in a person's respective left and right hands, and constrained to pivot about the pivot axis P4. For illustration purposes the handlebar 150 is generally I-shaped, requiring a user's legs to "straddle" an intermediate portion of the handlebar 150. On an alternative embodiment, the handlebar is configured as shown in the above-referenced Krull patent, so the user's legs can instead occupy a gap between left and right portions of the handlebar.

An intermediate portion of the handlebar 150 is pivotally connected to the second ends of the drawbars 170, thereby defining a pivot axis P5. An intermediate portion of the handlebar 150 is also pivotally connected to the first ends of relatively rearward drawbars 160, thereby defining a pivot axis P6. On the depicted embodiment 100, the pivot axes P5 and P6 are coaxial, but designated separately to emphasize that they may be disposed a radial distance apart from one another, as further discussed below. In any event, the pivot axes P5 and P6 are constrained to pivot about the pivot axis P4.

Opposite, second ends of the rearward drawbars 160 are pivotally connected to an intermediate portion of the rocker link 140, thereby defining a pivot axis P3, which is constrained to pivot about the pivot axis P1. As noted above with reference to the forward drawbars 170, persons skilled in the art will recognize that a single rearward drawbar may be used in the alternative and/or that the use of dual rearward drawbars 160 may more evenly distribute loads.

The links 140, 150, 160, and 170 may be described collectively as a linkage interconnected between the frame 110, the cranks 120, and the second end of the beam 130. All of the links in this linkage assembly are preferably rigid steel tubes, and all pivotal interconnections are made in a manner known in the art, for example, using nuts, bolts, and bushings. The linkage assembly links rotation of the cranks 120 to movement of the seat 133 through an elliptical path having a major axis that is greater than twice the radial distance between the crank axis C and the interface between the roller 123 and the beam 130 (i.e. the effective crank diameter), and a minor axis that is less than twice the effective crank diameter.

In operation, rotation of the cranks 120 is directly linked to up and down movement of the front end of the beam 130 (via the roller 123), and to back and forth pivoting of the handlebar 150 (via drawbars 170). The hand grips 151 and 152 pivot through a greater arc length than the pivot point P5 (for any given angular displacement range), and thus, pivot through an arc greater in length than the effective crank diameter. Back and forth pivoting of the handlebar 150 is directly linked to back and forth pivoting of the rocker link 140 (via drawbars 160), which in turn, causes back and forth movement of the rear end of the beam 130. The combination of the back and forth movement of the rear end of the beam 130 and the up and down movement of the front end of the beam 130 causes intermediate portions of the beam 130, as well as the seat 133, to move through respective elliptical paths. The up and down movement is limited by the effective crank diameter, but the back and forth movement is not, because the pivot point P2 pivots through a greater arc length than the pivot point P3 (for any given angular displacement range). One advantage of this "de-coupled" crank roller and drawbar approach is that a relatively long and low profile elliptical path may be generated on a relative short frame.

Another advantage is that the "stroke lengths" for the hand grips 151 and 152 and/or the seat 133 may be readily adjusted. For example, the stroke lengths for both the hand grips 151 and 152 and the seat 133 may be increased by moving the pivot point P5 closer to the pivot axis P4. Conversely, the stroke lengths for both the hand grips 151 and 152 and the seat 133 may be decreased by moving the pivot point P5 further from the pivot axis P4. In addition, the stroke length for the seat 133 can be independently increased by moving the pivot point P6 further from the pivot axis P4 and/or by moving the pivot point P3 closer to the pivot point P1, and the stroke length for the seat 133 can be independently decreased by moving the pivot point P6 closer to the pivot axis P4 and/or by moving the pivot point P3 further from the pivot point P1. As a result, the apparatus 100 can be tuned to produce different handle paths and/or seat paths. In addition, the lengths and/or shapes of the linkage components and/or the locations of the pivot points P1 and P4 can be adjusted to further "tune" the handle paths and/or the seat paths, depending on design parameters such as stroke length, stroke orientation, handle stroke relative to seat stroke, and others.

Figure 6C:
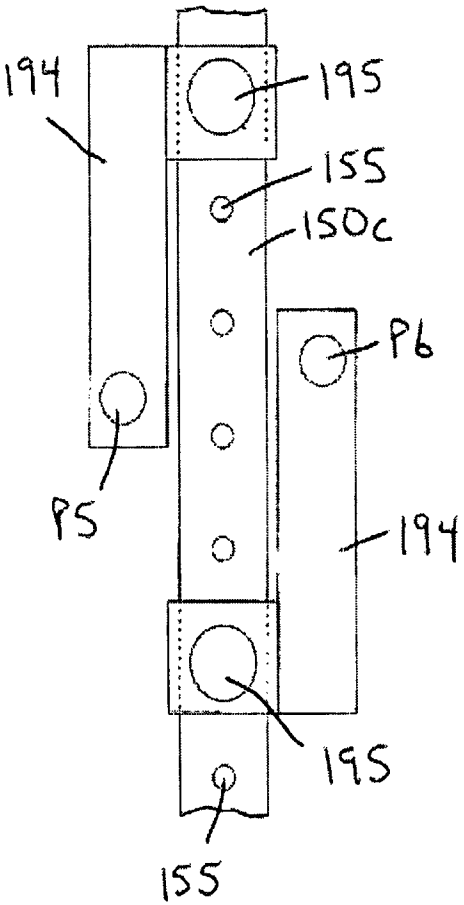
FIGS. 6*a*-6*c* are diagrammatic side views of adjustment mechanisms suitable for use on any of the embodiments shown in FIGS. 1-4.

Various mechanisms/means may be used to adjust the locations of the pivot points P3, P5, and/or P6 along respective links 140 and 150. For example, FIG. 6*a* shows a bracket 190 slidably mounted on a handlebar link 150*a*, which is identical to the handlebar link 150 except for the addition of a linear array of equally spaced holes 155 extending through the link 150*a*. The bracket 190 includes a first steel tube that sleeves onto the link 150*a*, and a second steel tube that is welded in place adjacent to the first steel tube. A shoulder bolt (not shown) is inserted through aligned holes in the drawbars 160 and 170 and the second tube and threaded into a nut to define the pivot axes P5 and P6. In a manner known in the art, a conventional fastener 195 is inserted through holes in the bracket 190 and aligned holes 155 in the link 150*a* to secure the bracket 190 in place along the link 150*a*.

Figure 6B:
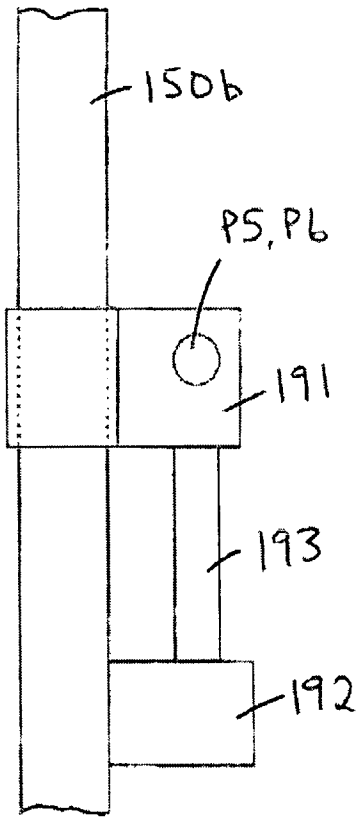
Figure 6A:
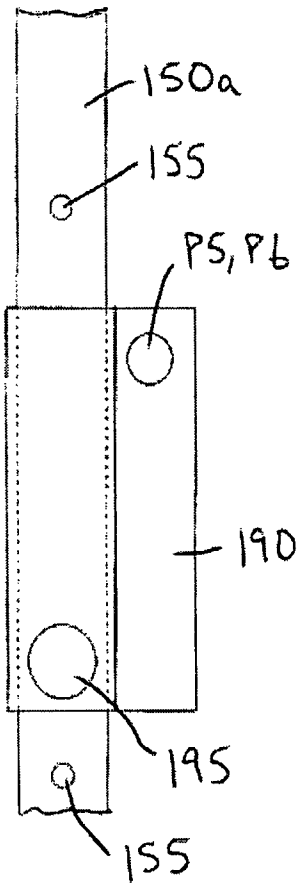

FIG. 6*b* shows a second pivot adjustment mechanism/means, including a bracket 191 that is slidably mounted on a handlebar link 150*b*, which is identical to the handlebar link 150 except for adaptations made to accommodate mounting of a stepper motor 192. The bracket 191 includes a first steel tube that sleeves onto the link 150*b*, and a second steel tube that is welded in place adjacent to the first steel tube. A shoulder bolt (not shown) is inserted through aligned holes in the drawbars 160 and 170 and the second tube, and threaded into a nut to define the pivot axes P5 and P6. In a manner known in the art, a lead screw 193 is operatively interconnected between the stepper motor 192 and the bracket 191 to move the bracket 191 in a first direction along the link 150*b* in response to operation of the motor 192 in a first direction, and alternatively, to move the bracket 191 in an opposite, second direction along the link 150*b* in response to operation of the motor 192 in an opposite, second direction. In a manner known in the art, the motor 192 operates in response to a control signal that may be generated by a control program and/or by user input via one or more input devices, such as buttons on the apparatus 100 and/or a cell phone, for example.

FIG. 6*c* shows a third pivot adjustment mechanism/means, including two brackets 194 that are slidably mounted on a handlebar link 150*c*, which is identical to the handlebar link 150*a*. Each bracket 194 includes a first steel tube that sleeves onto the link 150*c*, and a second steel tube that is welded in place adjacent to the first steel tube. A first shoulder bolt (not shown) is inserted through aligned holes in the drawbars 160 and the second tube and threaded into a nut to define the pivot axis P5. Similarly, a second shoulder bolt (not shown) is inserted through aligned holes in the drawbars 170 and the second tube and threaded into a nut to define the pivot axis P6. In a manner known in the art, conventional fasteners 195 are inserted through holes in respective brackets 194 and aligned holes 155 in the link 150*c* to separately secure each bracket 194 in place along the link 150*c*.

Figure 3:
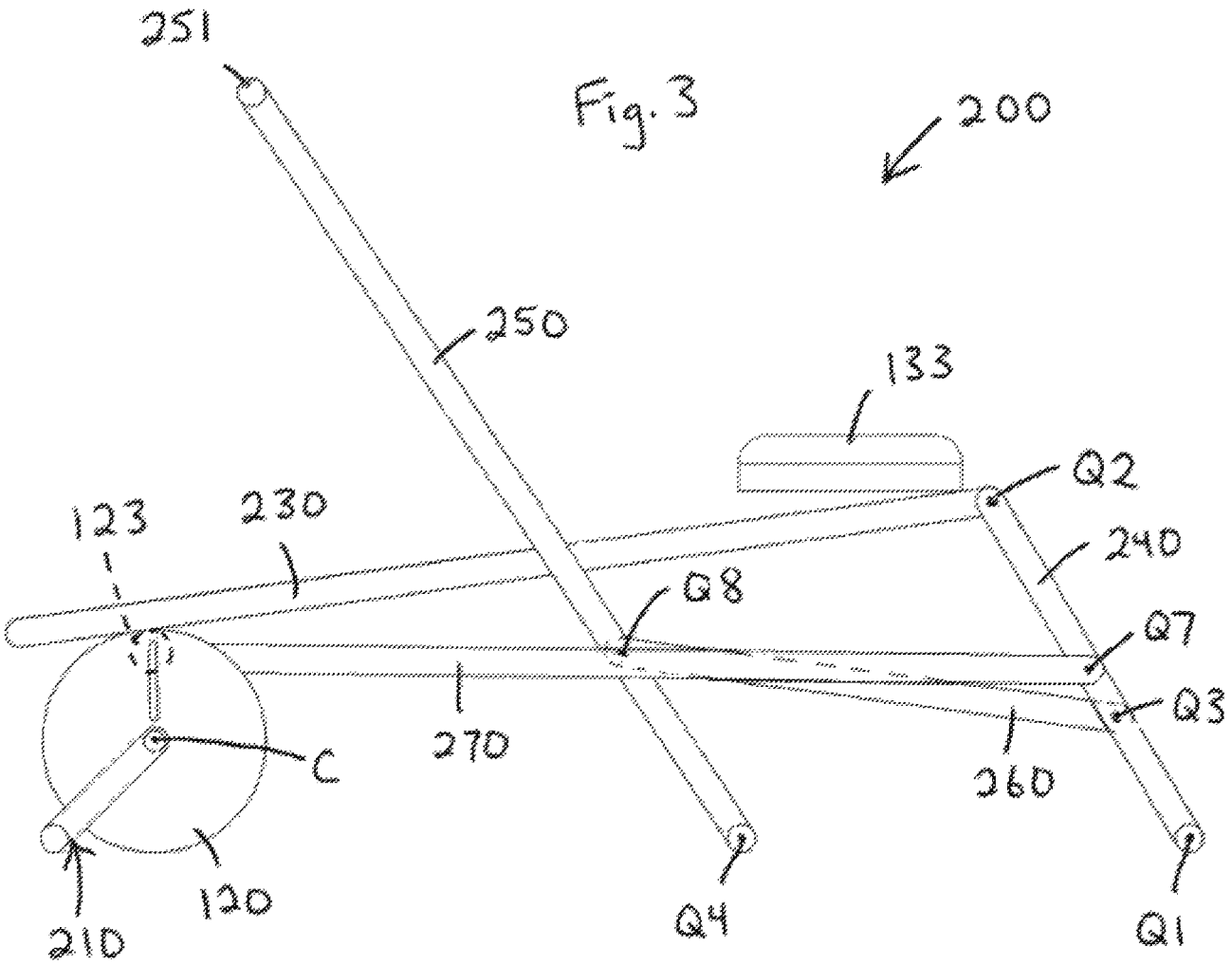
FIG. 3 is a diagrammatic side view of a second exercise apparatus constructed according to the principles of the present invention.

FIG. 3 shows a second exercise apparatus 200 constructed according to the principles of the present invention. The apparatus includes a frame 210, only a portion of which is shown in FIG. 3. The frame 210 includes a crank supporting stanchion (shown) and left and right base members (not shown) rigidly secured to the stanchion and extending the length of the apparatus 200 (left to right in FIG. 3). Transversely extending base members are preferably rigidly interconnected between the longitudinal base members to enhance structural integrity. Unless otherwise stated, all structural components of the frame 210 are preferably rigid steel tubes, and adjacent tubes are interconnected by known means, including nuts and bolts and/or welds.

As on the first embodiment 100, left and right cranks 120 are rotatably mounted on the frame 210, in a manner known in the art, to rotate together about a crank axis C; a shaft is rigidly interconnected between the cranks at a radial distance from the crank axis C, and the shaft extends parallel to the crank axis C; a crank roller 123 is rotatably mounted on the shaft; left and right drawbars or drawbar links 270 have first ends and opposite, second ends, and the first ends are rotatably mounted on respective ends of the radially displaced shaft (with the roller 123 disposed therebetween); a foot platform (not shown) is mounted on the frame 210 and preferably disposed above the cranks 120; at an end of the frame 210 opposite the cranks 120, a rocker link 240 has a lower end pivotally connected to the frame 210 for pivoting about a pivot axis Q1; an opposite, upper end of the rocker link 240 is "forked" and pivotally connected to a rearward end of a beam 230, thereby defining a pivot axis Q2, which is constrained to travel in an arc about the pivot axis Q1; an opposite, forward end of the beam 230 is disposed on top of the roller 123, thereby accommodating both rotation and translation of the beam 230 relative to the roller 123; and a conventional seat 133 is mounted on top of the beam 130 proximate the rearward end.

Between the cranks 120 and the rocker link 240, a rocker link or handlebar 250 has a lower end pivotally connected to the frame 210 for pivoting about a pivot axis Q4. For example, in a manner known in the art, bearings are disposed in left and right longitudinal frame members to receive opposite ends of a transversely extending shaft on the lower end of the handlebar 250. An opposite, upper end of the handlebar 250 includes left and right hand grips or handles that are sized and configured to be grasped in a person's respective left and right hands, and are constrained to pivot about the pivot axis Q4. The left handle is designated as 251 in FIG. 3, and the right handle is a mirror image thereof. The "upper half" of the handlebar 250 is preferably configured as shown in the above-referenced Krull patent, to accommodate the user's legs in a gap between left and right portions of the handlebar 250.

An intermediate portion of the handlebar 250 is pivotally connected to the first end of a single drawbar 260, thereby defining a pivot axis Q8, which is constrained to pivot about the pivot axis Q4. An opposite, second end of the drawbar 260 is pivotally connected to an intermediate portion of the rocker link 240, thereby defining a pivot axis Q3. This single drawbar 260 is straddled by and centered relative to the links 240 and 250 to evenly distribute loads. The second ends of the drawbars 170 are pivotally connected to the rocker link 240, thereby defining a pivot axis Q7. Both pivot axes Q7 and Q3 are constrained to pivot about the pivot axis Q1.

The links 240, 250, 260, and 270 may be described collectively as a linkage interconnected between the frame 210, the cranks 120, and the second end of the beam 230. All of the links in this linkage assembly are preferably rigid steel tubes, and all pivotal interconnections are made in a manner known in the art, for example, using nuts, bolts, and bushings. The linkage assembly components 240 and 270 link rotation of the cranks 120 to movement of the seat 133 through an elliptical path having a major axis that is greater than twice the radial distance between the crank axis C and the interface between the roller 123 and the beam (the effective crank diameter), and a minor axis that is less than twice the effective crank diameter, and cooperate with the linkage assembly components 250 and 260 to link rotation of the cranks 120 to movement of the hand grips (e.g. 251) through arcuate paths longer than twice the effective crank diameter.

In operation, rotation of the cranks 120 is directly linked to up and down movement of the front end of the beam 230 (via the roller 123), and to back and forth pivoting of the rocker link 240 (via drawbars 270). Back and forth pivoting of the rocker link 240 is directly linked to back and forth movement of the rear end of the beam 230, which cooperates with the up and down movement of the front end of the beam 230 to cause intermediate portions of the beam 230, as well as the seat 133, to move through respective elliptical paths. The up and down movement is limited by the effective crank diameter, but the back and forth movement is not, because the pivot point Q2 pivots through a greater arc length than the pivot point Q7 (for any given angular displacement range). One advantage of this "de-coupled" crank roller and drawbar approach is that a relatively long and low profile elliptical path may be generated on a relative short frame. Back and forth pivoting of the rocker link 240 is also directly linked to back and forth pivoting of the handlebar 250 (via drawbars 260). The hand grips 151 and 152 pivot through a greater arc length than the pivot point Q8 (for any given angular displacement range).

As on the first apparatus 100, the "stroke lengths" for the hand grips (e.g. 251) and/or the seat 133 on the second apparatus 200 may be readily adjusted. For example, the stroke lengths for both the hand grips (e.g. 251) and the seat 133 may be increased by moving the pivot point Q7 closer to the pivot axis Q1. Conversely, the stroke lengths for both the hand grips (e.g. 251) and the seat 133 may be decreased by moving the pivot point Q7 further from the pivot axis Q1. In addition, the stroke length for the hand grips (e.g. 251) can be independently increased by moving the pivot point Q3 further from the pivot axis Q1 and/or by moving the pivot point Q8 closer to the pivot point Q4, and the stroke length for the hand grips (e.g. 251) can be independently decreased by moving the pivot point Q3 closer to the pivot axis Q1 and/or by moving the pivot point Q8 further from the pivot point Q4. For example, as noted above with reference to the first apparatus 100, the adjustment mechanisms/means shown in FIGS. 6*a*-6*c* may be used to adjust the locations of one or more pivot axes on the second apparatus 200. As a result, the apparatus 200 can be tuned to produce different handle paths and/or seat paths. In addition, the lengths and/or shapes of the linkage components and/or the locations of the pivot points Q1 and Q4 can be adjusted to further "tune" the handle paths and/or the seat paths, depending on design parameters such as stroke length, stroke orientation, handle stroke relative to seat stroke, and others.

Figure 4:
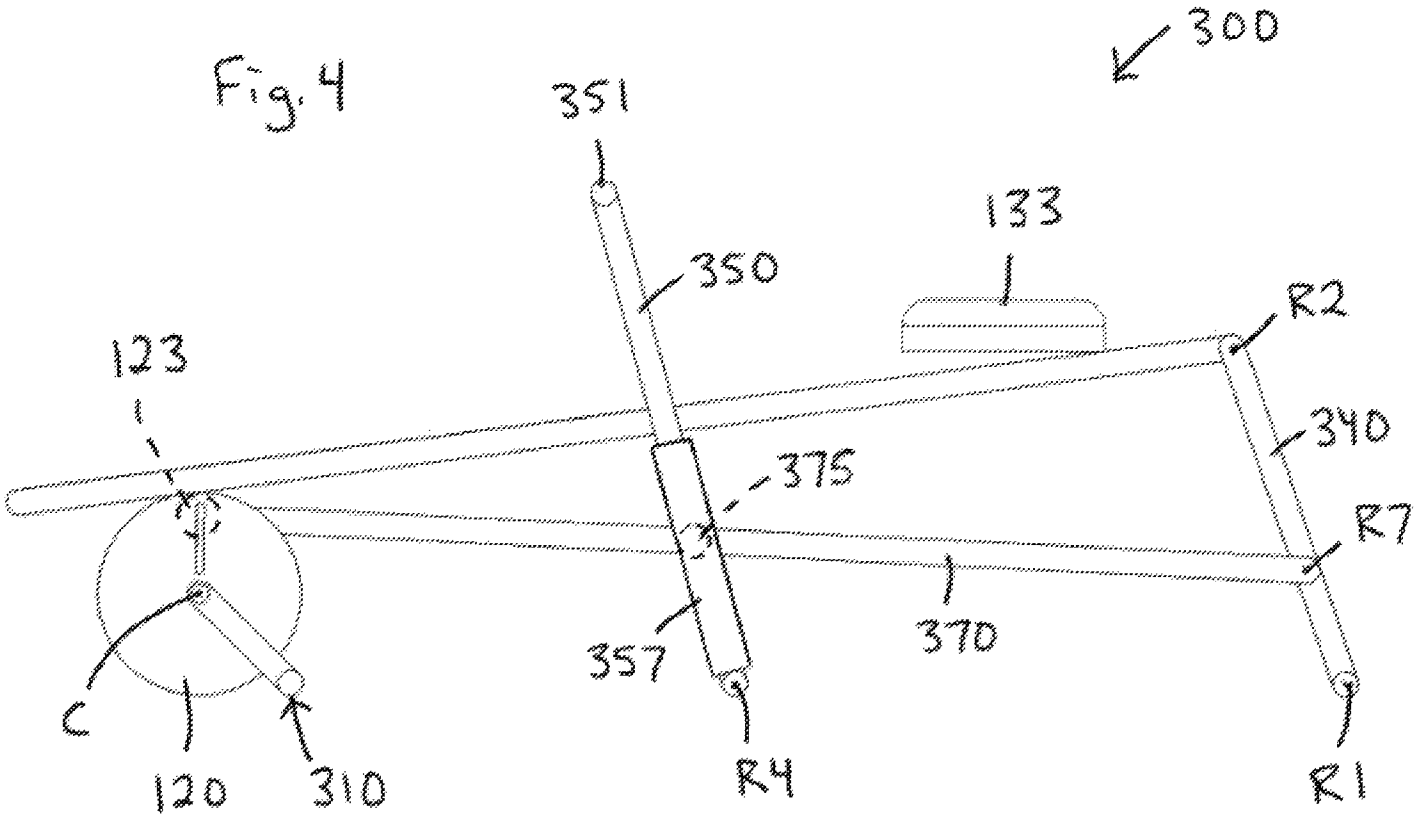
FIG. 4 is a diagrammatic side view of a third exercise apparatus constructed according to the principles of the present invention.

FIG. 4 shows a third exercise apparatus 300 constructed according to the principles of the present invention. The apparatus includes a frame 310, only a portion of which is shown in FIG. 4. The frame 310 includes a crank supporting stanchion (shown) and left and right base members (not shown) rigidly secured to the stanchion and extending the length of the apparatus 300 (left to right in FIG. 4). Transversely extending base members are preferably rigidly interconnected between the longitudinal base members to enhance structural integrity. Unless otherwise stated, all structural components of the frame 310 are preferably rigid steel tubes, and adjacent tubes are interconnected by known means, including nuts and bolts and/or welds.

As on the first embodiment 100, left and right cranks 120 are rotatably mounted on the frame 310, in a manner known in the art, to rotate together about a crank axis C; a shaft is rigidly interconnected between the cranks at a radial distance from the crank axis C, and the shaft extends parallel to the crank axis C; a crank roller 123 is rotatably mounted on the shaft; left and right drawbars or drawbar links 370 have first ends and opposite, second ends, and the first ends are rotatably mounted on respective ends of the radially displaced shaft (with the roller 123 disposed therebetween); a foot platform (not shown) is mounted on the frame 310 and preferably disposed above the cranks 120; at an end of the frame 310 opposite the cranks 120, a rocker link 340 has a lower end pivotally connected to the frame 310 for pivoting about a pivot axis R1; an opposite, upper end of the rocker link 340 is "forked" and pivotally connected to a rearward end of a beam 330, thereby defining a pivot axis R2, which is constrained to travel in an arc about the pivot axis R1; an opposite, forward end of the beam 330 is disposed on top of the roller 123, thereby accommodating both rotation and translation of the beam 330 relative to the roller 123; and a conventional seat 133 is mounted on top of the beam 330 proximate the rearward end.

As on the second apparatus 200, the second ends of the drawbar links 370 are pivotally connected to the rocker link 340, thereby defining a pivot axis R7, which is constrained to pivot about the pivot axis R1. Left and right rollers 375 are rotatably mounted on intermediate portions of respective drawbar links 370 for reasons discussed below.

Between the cranks 120 and the rocker link 340, a rocker link or handlebar 350 has a lower end pivotally connected to the frame 310 for pivoting about a pivot axis R4. For example, in a manner known in the art, bearings are disposed in left and right longitudinal frame members to receive opposite ends of a transversely extending shaft on the lower end of the handlebar 350. An opposite, upper end of the handlebar 350 includes left and right hand grips or handles that are sized and configured to be grasped in a person's respective left and right hands, and constrained to pivot about the pivot axis R4. The left handle is designated as 351 in FIG. 4, and the right handle is a mirror image thereof. The "upper half" of the handlebar 350 is configured as shown in the above-referenced Krull patent, to accommodate the user's legs in a gap between left and right portions of the handlebar.

Figure 5:
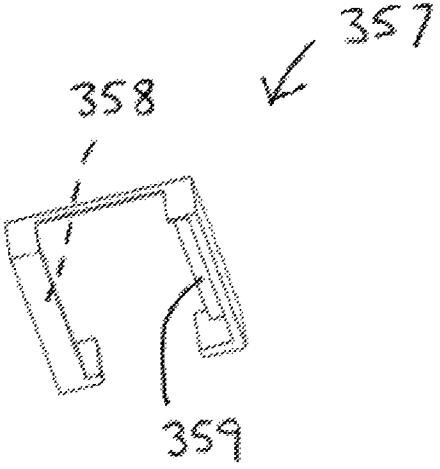
FIG. 5 is a perspective view of a component on the exercise apparatus of FIG. 4.

The "lower half" of the handlebar 350 includes a rigid bracket 357 that defines left and right bearing surfaces or races 358 and 359 that face in opposite, forward and rearward direction (see FIG. 5). The left roller 375 bears against the left race 358, and the right roller 375 bears against the right race 359. As a result, the rollers 375 roll along respective races 358 and 359 and transfer pushing and pulling forces between the drawbar links 370 and the handlebar 350.

The links 340, 350, and 370 may be described collectively as a linkage interconnected between the frame 310, the cranks 120, and the second end of the beam 330. All of the links in this linkage assembly are preferably rigid steel tubes, and all pivotal interconnections are made in a manner known in the art, for example, using nuts, bolts, and bushings. The linkage assembly components 340 and 370 link rotation of the cranks 120 to movement of the seat 133 through an elliptical path having a major axis that is greater than twice the radial distance between the crank axis C and the interface between the roller 123 and the beam 130 (the effective crank diameter), and a minor axis that is less than twice the effective crank diameter, and cooperate with the linkage assembly component 350 to link rotation of the cranks 120 to movement of the hand grips (e.g. 351) through arcuate paths longer than twice the effective crank diameter.

In operation, rotation of the cranks 120 is directly linked to up and down movement of the front end of the beam 330 (via the roller 123), and to back and forth pivoting of the rocker link 340 (via drawbars 370). Back and forth pivoting of the rocker link 340 is directly linked to back and forth movement of the rear end of the beam 330, which cooperates with up and down movement of the front end of the beam 330 to cause intermediate portions of the beam 330, as well as the seat 133, to move through respective elliptical paths. The up and down movement is limited by the effective crank diameter, but the back and forth movement is not, because the pivot point R2 pivots through a greater arc length than the pivot point R7 (for any given angular displacement range). One advantage of this "de-coupled" crank roller and drawbar approach is that a relatively long and low profile elliptical path may be generated on a relative short frame Back and forth movement of the drawbar links 370 is also directly linked to back and forth pivoting of the handlebar 350 (via rollers 375). The hand grips (e.g. 351) pivot through a greater arc length than the races 358 and 359 (for any given angular displacement range).

As on the first apparatus 100, the "stroke lengths" for the hand grips (e.g. 351) and/or the seat 133 on the third apparatus 300 may be readily adjusted. For example, the stroke lengths for both the hand grips (e.g. 351) and the seat 133 may be increased by moving the pivot point R7 closer to the pivot axis R1. Conversely, the stroke lengths for both the hand grips (e.g. 351) and the seat 133 may be decreased by moving the pivot point R7 further from the pivot axis R1. For example, as noted above with reference to the first apparatus 100, the adjustment mechanisms/means shown in FIGS. 6*a*-6*c* may be used to adjust the location of the pivot axis R7 along the rocker link 340. As a result, the apparatus 300 can be tuned to produce different handle paths and/or seat paths. In addition, the lengths and/or shapes of the linkage components and/or the locations of the pivot points R1 and R4 can be adjusted to further "tune" the handle paths and/or the seat paths, depending on design parameters such as stroke length, stroke orientation, handle stroke relative to seat stroke, and others.

The present invention may also be described in terms of various methods with reference to the embodiments discussed above. For example, one such method may be described as facilitating a rowing-type exercise 100 with a seat 133 that moves through an elliptical path of motion that is selectively adjustable, comprising the steps of: providing an exercise apparatus 100 having a frame 110 configured to rest on a floor surface; a crank 120 rotatably mounted on the frame 110 for rotation about a crank axis C; and a linkage assembly interconnected between the frame 110 and the crank 120, the linkage assembly including a rocker link 140 pivotally mounted on the frame 140 for pivoting about a pivot axis P1, a seat supporting member 130 movably interconnected between the crank 120 and the rocker link 150, a seat 130 disposed on top of the seat supporting member 130, and at least one drawbar link 160, 170 interconnected between the crank 120 and the rocker link 140 in a manner that links rotation of the crank 120 to movement of the seat 133 through an elliptical path having a major axis that is amplified to exceed an effective crank diameter defined by the crank 120; and repositioning one component 160, 170 of said at least one drawbar link relative to the rocker link to alter the elliptical path.

The present invention has been described with reference to particular embodiments and specific applications. However, this disclosure will enable persons skilled in the art to derive additional modifications, improvements, and/or applications that nonetheless embody the essence of the invention. For example, persons skilled in the art will recognize that features of the many embodiments shown and/or described herein (and/or obvious substitutions therefor) may be interchanged with features on other embodiments, as well as mixed and matched in various combinations, to arrive at still more embodiments of the present invention. In addition, other linking means/assemblies (in addition to those described above and shown in the accompanying drawings) may be used to de-couple the seat travel relative to the effective crank diameter. For example, the seat supporting beam may be pivotally interconnected between the crank and the rear rocker link, and the seat may be movably mounted on the beam, and a drawbar may be pivotally interconnected between the rear rocker link and the seat to drive the seat back and forth relative to the beam as the crank cooperates with the rear rocker link to drive the beam through an elliptical path. Some variations of this de-coupling arrangement or means are disclosed in U.S. Pat. No. 6,629,909 to Stearns et al, which is incorporated herein by reference. In view of the foregoing, the scope of the present invention is to be limited only to the extent of the following claims.

The invention claimed is:

1. An exercise apparatus, comprising:

a frame configured to rest on a floor surface;

a crank rotatably mounted on the frame for rotation about a crank axis;

a beam having a first end and an opposite, second end, wherein the first end is movably supported by the crank at a radial distance from the crank axis and in a manner that accommodates both rotation and translation therebetween;

a seat disposed on top of the beam; and a linkage assembly interconnected between the frame, the crank, and the second end of the beam in a manner that links rotation of the crank to movement of the seat through an elliptical path having a major axis that is greater than twice the radial distance and a minor axis that is less than twice the radial distance.

2. The exercise apparatus of claim 1, wherein the linkage assembly includes a handlebar link having a pivot end and an opposite, handle end, wherein the pivot end is pivotally mounted on the frame, and the linkage assembly links rotation of the crank to movement of the handle end through an arcuate path that is greater in length than twice the radial distance.

3. The exercise apparatus of claim 1, wherein the linkage assembly includes a rocker link having a pivot end and an opposite, distal end, and the pivot end is pivotally mounted on the frame, and the distal end is pivotally connected to the second end of the beam.

4. The exercise apparatus of claim 3, wherein the linkage assembly further includes at least one drawbar operatively interconnected between the crank and the rocker link.

5. The exercise apparatus of claim 4, wherein the at least one drawbar includes a rigid member having a first end and an opposite, second end, and the first end of the rigid member is pivotally connected to the crank, and the second end of the rigid member is pivotally connected to the rocker link.

6. The exercise apparatus of claim 5, wherein the second end of the rigid member is selectively movable along the rocker link to adjust range of motion of the seat relative to the frame.

7. The exercise apparatus of claim 5, wherein the linkage assembly includes a handlebar link having a pivot end and an opposite, handle end, wherein the pivot end of the handlebar link is pivotally mounted on the frame, and an intermediate portion of the rigid member is movably connected to an intermediate portion of the handlebar link in a manner that accommodates both rotation and translation therebetween.

8. The exercise apparatus of claim 7, wherein the second end of the rigid member is selectively movable along the rocker link to contemporaneously adjust both range of motion of the seat relative to the frame and range of motion of the handle end of the handlebar link relative to the frame.

9. The exercise apparatus of claim 5, wherein the linkage assembly includes a handlebar link having a pivot end and an opposite, handle end, wherein the pivot end of the handlebar link is pivotally mounted on the frame, and the linkage assembly further includes a second rigid member having a first end pivotally connected to the rocker link for pivoting about a first pivot axis, and an opposite, second end pivotally connected to an intermediate portion of the handlebar link for pivoting about a second pivot axis.

10. The exercise apparatus of claim 9, wherein the second end of the first said rigid member is selectively movable along the rocker link to contemporaneously adjust both range of motion of the seat relative to the frame and range of motion of the handle end of the handlebar link relative to the frame.

11. The exercise apparatus of claim 9, wherein at least one said pivot axis is selectively movable along a respective portion of the linkage assembly to adjust range of motion of the handle end of the handlebar link relative to the frame.

12. The exercise apparatus of claim 4, wherein the linkage assembly includes a handlebar link having a pivot end and an opposite, handle end, wherein the pivot end of the handlebar link is pivotally mounted on the frame, and the at least one drawbar includes (a) a first rigid member having a first end rotatably connected to the crank, and an opposite, second end rotatably connected to an intermediate portion of the handlebar link; and (b) a second rigid member having a first end rotatably connected to an intermediate portion of the handlebar link; and an opposite, second end rotatably connected to the rocker link.

13. The exercise apparatus of claim 12, wherein the second end of the first rigid member is selectively movable along the handlebar link to contemporaneously adjust both range of motion of the seat relative to the frame and range of motion of the handle end of the handlebar link relative to the frame.

14. The exercise apparatus of claim 12, wherein the first end of the second rigid member is selectively movable along the handlebar link to contemporaneously adjust range of motion of the seat relative to the frame.

15. The exercise apparatus of claim 12, wherein the second end of the second rigid member is selectively movable along the rocker link to adjust range of motion of the seat relative to the frame.

16. The exercise apparatus of claim 2, further comprising adjusting means for contemporaneously adjusting both range of motion for the elliptical path and range of motion for the arcuate path.

17. A method of facilitating a rowing-type exercise with a seat that moves through an elliptical path of motion that is selectively adjustable, comprising the steps of:

providing an exercise apparatus having a frame configured to rest on a floor surface; a crank rotatably mounted on the frame for rotation about a crank axis; a beam having a first end and an opposite, second end, wherein the first end is movably supported by the crank at a radial distance from the crank axis and in a manner that accommodates both rotation and translation therebetween; a seat disposed on top of the beam; and a linkage assembly, including a first link and a second link, interconnected between the frame, the crank, and the second end of the beam in a manner that links rotation of the crank to movement of the seat through an elliptical path having a major axis that is amplified to exceed an effective crank diameter defined by the crank; and repositioning the first link relative to the second link to alter the elliptical path.

18. An exercise apparatus, comprising:

a frame configured to rest on a floor surface;

a crank rotatably mounted on the frame for rotation about a crank axis;

a rocker link pivotally mounted on the frame for pivoting about a pivot axis;

a seat beam having a first end and an opposite, second end, wherein the first end is movably supported by the crank at a radial distance from the crank axis and in a manner that accommodates both rotation and translation therebetween, and the second end is pivotally connected to the rocker link at a first pivot distance from the pivot axis;

a seat disposed on top of the beam; and at least one drawbar link having a forwardmost end rotatably connected to the crank, and an opposite, rearwardmost end pivotally connected to the rocker link at a second pivot distance from the pivot axis, wherein the second pivot distance is less than the first pivot distance, and the seat is thereby constrained to move through an elliptical path having a major axis that is amplified to exceed an effective crank diameter defined by rotation of the crank.

19. The exercise apparatus of claim 18, further comprising an adjustment bracket that is selectively repositioned along the rocker link, wherein the rearwardmost end is pivotally connected to the bracket.

20. The exercise apparatus of claim 18, further comprising a handlebar link pivotally mounted on the frame for pivoting about a handle axis, and a connector link pivotally interconnected between the handlebar link and the rocker link.

21. The exercise apparatus of claim 18, further comprising a handlebar link pivotally mounted on the frame for pivoting about a handle axis, and first and second rollers rotatably mounted on said at least one drawbar link and bearing against opposite facing surfaces on the handlebar link.

* * * * *